US007623145B2

(12) United States Patent
Taguchi

(10) Patent No.: US 7,623,145 B2
(45) Date of Patent: Nov. 24, 2009

(54) DUPLEX PRINTER

(75) Inventor: Hiroyuki Taguchi, Kawasaki (JP)

(73) Assignees: Toshiba Tec Kabushiki Kaisha, Tokyo (JP); NCR Corporation, Dayton, OH (US)

( * ) Notice: Subject to any disclaimer, the term of this patent is extended or adjusted under 35 U.S.C. 154(b) by 101 days.

(21) Appl. No.: 11/681,918

(22) Filed: Mar. 5, 2007

(65) Prior Publication Data

US 2007/0280719 A1 Dec. 6, 2007

(30) Foreign Application Priority Data

Jun. 2, 2006 (JP) ..... 2006-155026

(51) Int. Cl.
*B41J 2/32* (2006.01)

(52) U.S. Cl. ..... 347/171; 400/82

(58) Field of Classification Search ..... 347/171; 400/188, 82

See application file for complete search history.

(56) References Cited

U.S. PATENT DOCUMENTS

| | | | | |
|---|---|---|---|---|
| 6,118,469 | A | 9/2000 | Hosomi | |
| 6,296,405 | B1 * | 10/2001 | Brewington et al. | 400/188 |
| 6,447,182 | B2 * | 9/2002 | Brewington et al. | 400/188 |
| 6,759,366 | B2 | 7/2004 | Beckerdite et al. | |
| 6,784,906 | B2 | 8/2004 | Long et al. | |
| 2003/0025779 | A1 | 2/2003 | Miyazaki | |
| 2003/0143007 | A1 | 7/2003 | Vives et al. | |
| 2004/0156664 | A1 * | 8/2004 | Vives et al. | 400/82 |
| 2007/0212146 | A1 * | 9/2007 | Lyons et al. | 400/82 |

FOREIGN PATENT DOCUMENTS

| | | |
|---|---|---|
| EP | 0947340 | 10/1999 |
| EP | 1321296 | 6/2003 |
| JP | 58-008668 | 1/1983 |
| JP | 61-003765 | 1/1986 |
| JP | 03-051149 | 3/1991 |
| JP | 06-024082 | 2/1994 |
| JP | 09-233256 | 9/1997 |
| JP | 10-076713 | 3/1998 |
| JP | 11-286147 | 10/1999 |
| JP | 2000-347533 | 12/2000 |
| JP | 2001-199095 | 7/2001 |
| JP | 2002-234215 | 8/2002 |
| JP | 2003-048363 | 2/2003 |

OTHER PUBLICATIONS

Computer-generated translation of JP 2002-234215.*
Computer-generated translation of JP 2003-048363, published on Feb. 18, 2003.*
Japanese Office Action dated Jun. 11, 2008 corresponding to U.S. Appl. No. 11/681,918 filed on Mar. 5, 2007.
European Search Report for EP 07 10 9275 dated Jul. 4, 2008 corresponding to U.S. Appl. No. 11/681,918 filed on Mar. 5, 2007.
Chinese Office Action dated Jan. 23, 2009 corresponding to U.S. Appl. No. 11/681,918 filed Mar. 5, 2007.
Japanese Office Action dated May 19, 2009 corresponding to U.S. Appl. No. 11/681,918 filed on Mar. 5, 2007.

* cited by examiner

*Primary Examiner*—Huan H Tran
(74) *Attorney, Agent, or Firm*—Turocy & Watson, LLP

(57) ABSTRACT

A duplex printer, in which when a first thermal head prints information on a front side as an information printing side of a printing medium, a second thermal head repeatedly prints a previously registered and selected fixed pattern or notice information on a back side as an information non-printing side of a printing medium at regular cycle or at an optional timing.

15 Claims, 3 Drawing Sheets

DUPLEX PRINTER

CROSS-REFERENCE TO RELATED APPLICATIONS

This application is based upon and claims the benefit of priority from prior Japanese Patent Application No. 2006-155026, filed Jun. 2, 2006, the entire contents of which are incorporated herein by reference.

BACKGROUND OF THE INVENTION

1. Field of the Invention

The present invention relates to a duplex printer, which repeatedly prints a pattern on an information non-printing side of a printing medium, when printing information consisting of image and character on an information printing side of a printing medium.

2. Description of the Related Art

Generally, a printer prints information consisting of image and characters on a printing medium. When printing information, a printing head of a printer is faced to a front side (information printing side) as a first side of a printing medium. A printer feeds a printing medium, and prints information on it in this state. Therefore, information is printed only on a front side of a printing medium. Nothing is printed on a back side (information non-printing side) as a second side of a printing medium. When a receipt or ticket is issued, a fixed pattern or advertisement is already printed on a back side of a receipt or ticket. A printing medium with a fixed pattern or advertisement preprinted on a back side is used for a receipt or ticket.

For example, U.S. Pat. No. 6,759,366 discloses a duplex printer having two thermal heads. This duplex printer prints both sides of a printing medium (heat-sensitive paper). The duplex printer has two platens. A first thermal head and a first platen are arranged opposite to each other. A second thermal head and a second platen are arranged opposite to each other. A printing medium is held and conveyed by these thermal heads and platens. The first thermal head and first platen are arranged in the upstream of the second thermal head and second platen in the conveying direction. Therefore, the duplex printer prints information on both sides of a printing medium substantially at the same time.

When information is printed only on the front side of a printing medium, information not to be printed on the front side (hereinafter called a first information) is successively printed on the front side of a printing medium of size different from the printing medium whose front side has been printed, or on the front side of the printing medium whose front side has been printed. As a result, if first information is printed on the front side of a printing medium of the size different from the printing medium whose front side has been printed, the number of kinds of printing medium to be managed in increased. This increases the number of needless printing medium stock. When first information is successively printed on a front side of a printing medium that is already printed, the amount of using a printing medium is increased.

In a printing medium whose back side has been printed, information different from information printed on the front side has been printed on the back side. Thus, the amount of using a printing medium when printing the front side and back side, is smaller than the amount of using a printing medium when printing only the front side. However, as a different printer is used for printing, a printing medium whose back side is already printed requires a relatively high cost. If advertisement or notice information is already printed on a printing medium used as a roll paper such as a receipt and ticket, the printed information goes out of date as the printing medium is used for a long time. For example, a printing medium with printed advertisement is prepared assuming the amount of use before the advertisement period, and will be unusable after the effective advertisement period is expired, and the printing medium will be discarded. As for a fixed pattern, it has been printed, and cannot be easily changed by the user.

BRIEF SUMMARY OF THE INVENTION

It is an object of the present invention to provide a duplex printer using a low-cost printing medium, which use a printing medium whose information non-printing side is unprinted, selects a desired one of preset fixed patterns and notice information, and prints a fixed pattern or notice information at regular cycle on an non-information printing side of a printing medium, when printing optional information on an information printing side of a printing medium.

According the present invention, there is provided a duplex printer comprising a first thermal head which contacts a first side of a conveying printing medium, and prints information included in printing data; a second thermal head which contacts a second side of the printing medium, and prints specified information; a memory which stores the printing data and one or more fixed pattern and notice information; and a printing style setting unit which selects and sets a printing style for the printing data, and the fixed pattern or notice information becoming the specified information; wherein the second thermal head repeatedly prints the fixed pattern or notice information selected and set by the printing style setting unit on the second side of the printing medium, in synchronization with the printing on the first side of the printing medium by the first thermal head.

According to the present invention, there is provided a duplex printer using a low-cost printing medium, which uses a printing medium whose information non-printing side is unprinted, selects a desired one of preset fixed patterns or notice information, and prints a fixed pattern or notice information at regular cycle on an information non-printing side of a printing medium, when printing optional information on an information printing side of a printing medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be explained in detail hereinafter with reference to the accompanying drawings.

Figure 1:
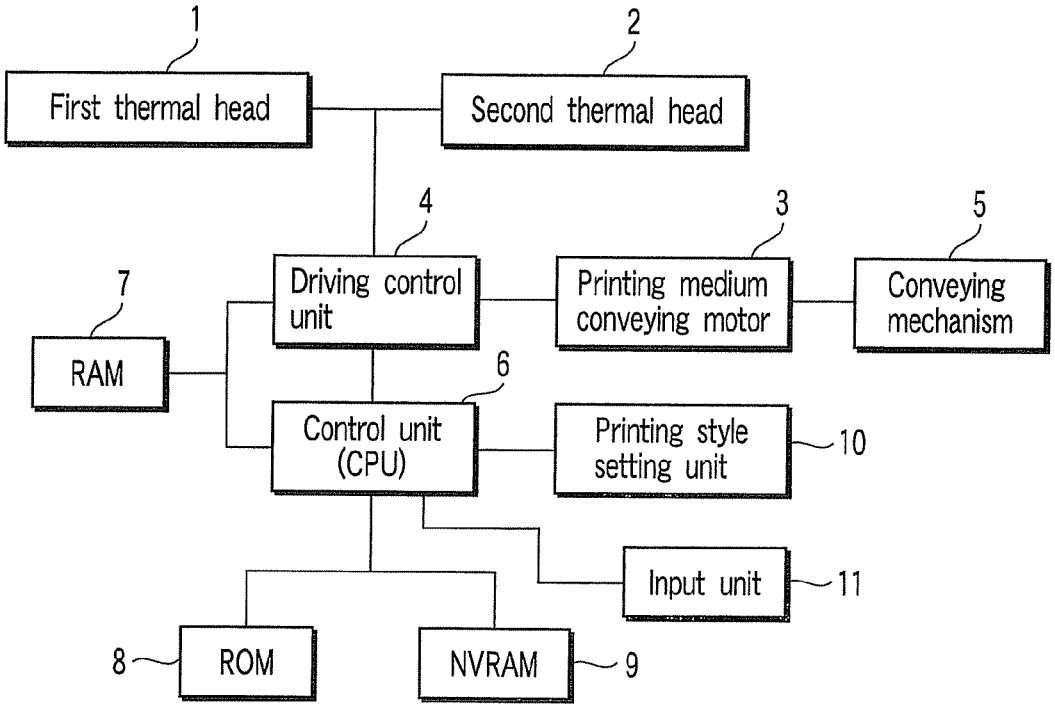
FIG. 1 is a diagram showing a conceptual configuration of a character attribute management system incorporated in a duplex printer according to an embodiment of the present invention, which performs duplex printing by using a thermal head as a printing head.
Figure 2:
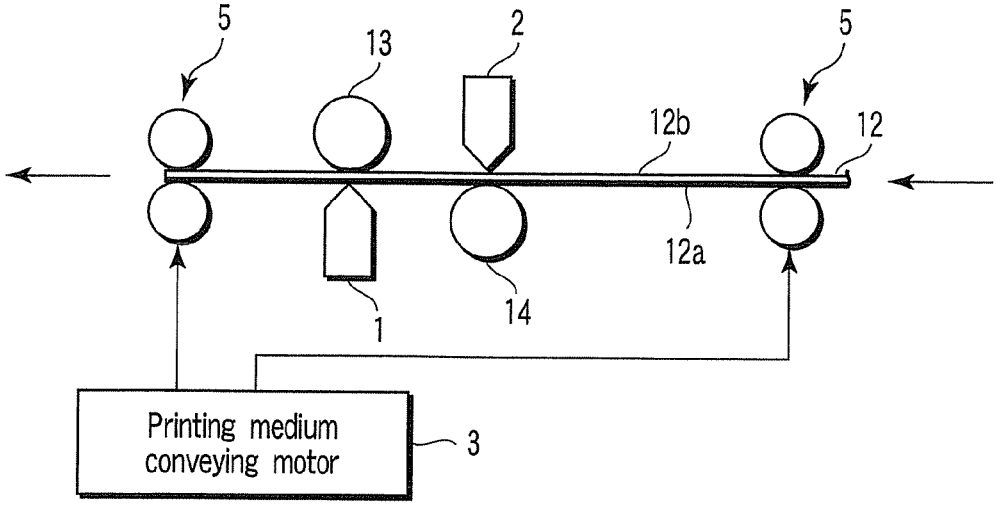
FIG. 2 is an illustration showing a conceptual configuration of a thermal head and a conveying mechanism.

FIG. 1 shows a conceptual configuration of a character attribute management system incorporated in a duplex printer according to an embodiment of the present invention, which performs duplex printing by using a thermal head as a printing head. FIG. 2 shows a conceptual configuration of a thermal head and a conveying mechanism.

In the following explanation, a medium printable on both sides such as a photo-sensitive paper is used as a printing medium. An information printing side of a printing medium to print image data or printing data including characters/numeric information will be explained as a first side (hereinafter, called a front side 12*a*) of a printing medium. An information non-printing side of a printing medium to repeatedly print specified information such as fixed patterns or notice information explained later will be explained as a second side (hereinafter, called a back side 12*b*) of a printing medium.

The duplex printer has a first thermal head 1 to contact a front side 12*a*, a second thermal head 2 to contact a back side 12*b*, a conveying mechanism 5 to convey a printing medium 12, a printing medium conveying motor 3 to drive the conveying mechanism 5, a drive control unit 4 to control driving of the first thermal head 1, second thermal head 2 and printing medium conveying motor 3, a control unit (CPU) 6 to control a whole system and perform arithmetic computations based on instructions from a predetermined program or user, a RAM 7 to store printing data and one or more fixed pattern and notice information described later, a ROM 8 to store a predetermined program, a nonvolatile RAM (NV RAM) 9 to store parameters entered by the user, a printing style setting unit 10 to set a printing style, and an input unit 11. In this embodiment, the RAM 7 stores the printing data and one or more fixed pattern and notice information described later. The storing means is not limited to the RAM 7, as long as information is rewritable. For example, a flash ROM and hard disc may be used.

In this configuration, the printing, data stored in the RAM 7 includes image data and characters/numeric information entered from an external host system (a externally connected computer). This printing data is printed on the front side 12*a*. At least one or more fixed pattern stored in the RAM 7 is printed at least one on the back side 12*b*. The notice information stored in the RAM 7 includes latest advertisement or notice. The notice information is printed at least one on the back side 12*b*.

The drive control unit 4 has a driver function to independently drive the first and second thermal heads 1 and 2.

The printing style setting unit 10 has a setup function. The printing style setting unit 10 sets a printing style such as character attributes for the printing data output from the first thermal head 2 and the second thermal head 2. In this time, the printing style setting unit 10 sets an enlarging rate to print information enlarged on the front side 12*a* or back side 12*b*, and a reducing rate to print the information reduced on the front side 12*a* or back side 12*b*. The enlarging rate or reducing rate to print information can be optionally set. The printing style setting unit 10 enlarges space 33, gap 36, and interval 43 described later at the enlarging rate. The printing style setting unit 10 reduces the space 33, gap 36, and interval 43 at the reducing rate. The printing style setting unit 10 sets the space 33 and gap 36, and interval 43 between printing information at an optical rate. The printing style setting unit 10 combines the printing positions of fixed pattern or notice information set at the enlarging or reducing rate. Namely, the printing style setting unit 10 sets combination when printing enlarged and reduced information in combination. The printing style setting unit 10 selects any one of fixed pattern and notice information specified by the user and printed on the back side 12*b*. The printing style setting unit 10 sets to print one of the fixed pattern and notice information at regular cycle or at an optional timing.

The input unit 11 has a touch panel or a key input panel having a display function to confirm the setting contents. The input unit 11 selects a fixed pattern and notice information, and inputs a printing format (including a style), an instruction to start printing, and lengths of the gap 36 and interval 43.

The first and second thermal heads 1 and 2 are placed as shown in FIG. 2, for example. In this placement example, the first thermal head 1 contacts the front side 12*a*. A platen roller 13 is provided on the back side 12*b*. The second thermal head 2 contacts the back side 12*b*. The platen roller 13 is opposite to the first thermal head 1 through a printing medium 12. A platen roller 14 is provided on the front side 12*a*. The platen roller 14 is opposite to the second thermal head 2 through the printing medium 12. The platen rollers 13 and 14 may be provided with an individual driving motor. The platen rollers 13 and 14 may also be provided with a transmission mechanism, and may use the printing medium conveying motor 3 as a driving source. In the downstream of the first thermal head 1, the conveying mechanism 5 is provided to convey the printing medium 12. In the upstream of the second thermal head 2, the conveying mechanism 5 is provided to convey the printing medium 12. The duplex printer is also provided with a supply unit (not shown) to supply an unprinted printing medium 12, and a housing (not shown) to house a printed printing medium 12. The conveying mechanism 5, supply unit and housing are commonly used and applicable either to cut-sheet paper or roll paper of the printing medium 12.

In the duplex printer of this embodiment, before the first thermal head 1 prints printing data on the front side 12*a*, the printing style setting unit 10 selects and sets a desired one or more fixed pattern or notice information stored in the ROM 8, for example one fixed pattern, according to a control command. Then, the first thermal head 1 prints printing data on the front side 12*a*. Synchronizing with the printing on the front side 12*a*, the duplex printer prints a fixed pattern set by the printing style setting unit 10 on the back side 12*b* at regular cycle or at an optional timing. The fixed pattern is repeatedly printed by the second thermal head 2.

Figure 3:
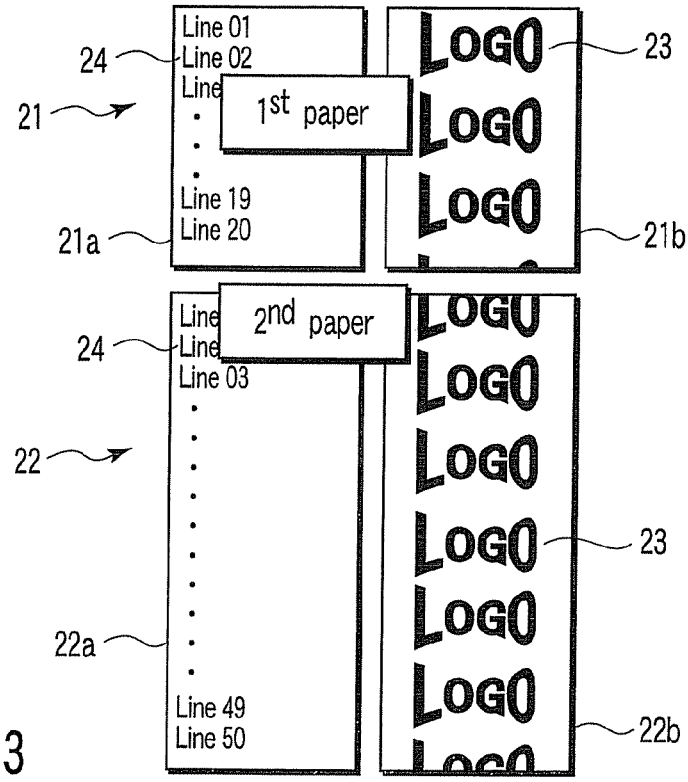
FIG. 3 is a view showing a first example of a fixed pattern to be printed on a back side by a second thermal head.

FIG. 3 shows a first example of a fixed pattern printed on the back side by the second thermal head 2.

In the first example shown in FIG. 3, information 24 (Line 01-Line 20) included in the printing data is printed on the front side 21*a* of a first printing medium 21. A selected fixed pattern "LOGO" 23 is printed on the back side 21*b* of the first printing medium 21. Likewise, information 24 (Line 01-Line 50) included in the printing data is printed on the front side 22*a* of a second printing medium 22. A selected fixed pattern "LOGO" 23 is printed on the back side 22*b* of the second printing medium 22.

In the first example, a print start timing is synchronized with the conveying state of printing medium 21 and 22 (the forward ends of the printing medium 21 and 22 reach the second thermal head 2). Therefore, in the first example, the selected fixed pattern "LOGO" is continuously printed without taking an gap.

Figure 4:
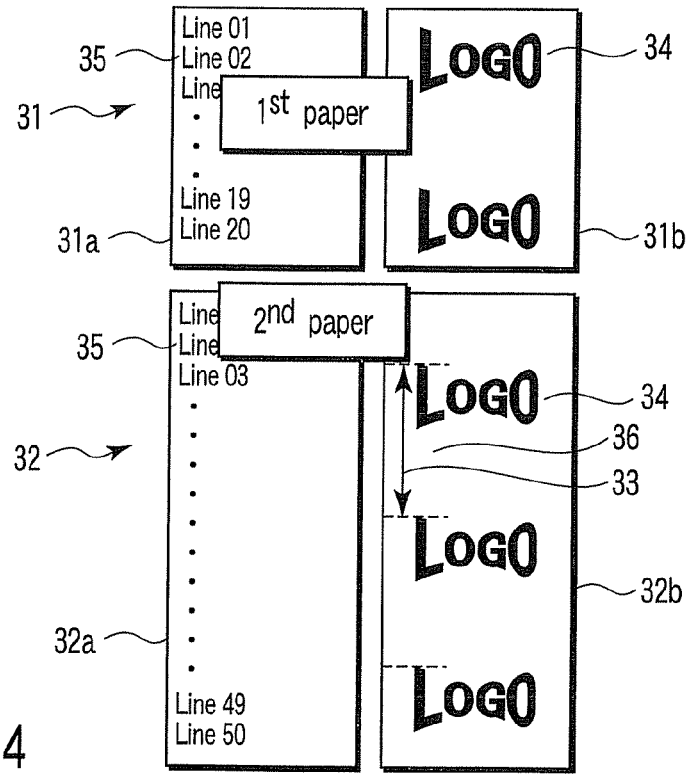
FIG. 4 is a view showing a second example of a fixed pattern to be printed on a back side by a second thermal head.

FIG. 4 shows a second example of a fixed pattern printed on the back side by the second thermal head 2.

In the second example shown in FIG. 4, information 35 (Line 01-Line 20) included in the printing data is printed on the front side 31*a* of a first printing medium 31. A selected fixed pattern "LOGO" 34 is printed on the back side 31*b* of the first printing medium 31. Likewise, information 35 (Line 01-Line 50) included in the printing data is printed on the front side 32*a* of a second printing medium 32. A selected fixed pattern "LOGO" 34 is printed on the back side 32*b* of the second printing medium 32 with the gap 36.

In the second example, a print start timing is synchronized with the conveying state of printing medium 31 and 32 (the forward ends of the printing medium 31 and 32 reach the second thermal head 2). Therefore, in the second example, the selected fixed pattern "LOGO" 34 and the space 33 including the specified gap 36 subsequent to the "LOGO" 34 are continuously printed, based on the control command or setting by the printing style setting unit 10.

When the "LOGO" 34 is enlarged or reduced by the printing style setting unit 10 as described above, the gap 36 is enlarged or reduced at the same rate as the "LOGO" 34. The gap 36 may be set to an optional length by the printing style setting unit 10. The enlarged "LOGO" 34 and reduced "LOGO" 34 may be alternately printed on the back side 32*b*. Combination of enlarged "LOGO" 34 and reduced "LOGO" 34 can be optionally set by the printing style setting unit 10.

Figure 5:
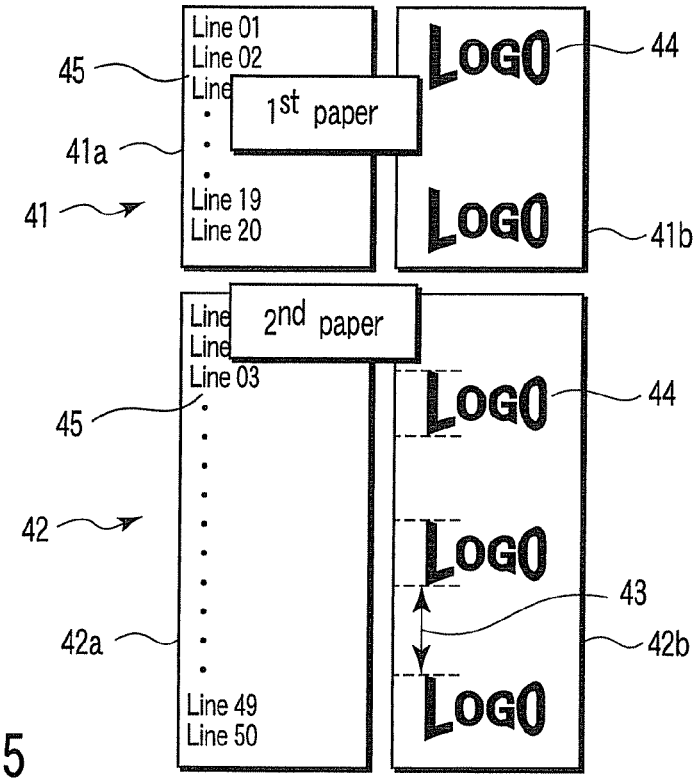
FIG. 5 is a view showing a third example of a fixed pattern to be printed on a back side by a second thermal head.

FIG. 5 shows a third example of a fixed pattern printed on the back side by the second thermal head 2.

In the third example shown in FIG. 5, information 45 (Line 01-Line 20) included in the printing data is printed on the front side 41*a* of a first printing medium 41. A selected fixed pattern "LOGO" 44 is printed on the back side 41*b* of the first printing medium 41. Likewise, information 45 (Line 01-Line 50) included in the printing data is printed on the front side 42*a* of a second printing medium 42. A selected fixed pattern "LOGO" 44 is printed on the back side 42*b* of the second printing medium 42 with the specified interval 43.

In the third example, a print start timing is synchronized with the conveying state of printing medium 41 and 42 (the forward ends of the printing medium 41 and 42 reach the second thermal head 2). A print start position is specified by a control command or setting by the printing style setting unit 10. Therefore, in the third example, a fixed pattern is repeatedly printed taking the specified interval 43 to the adjacent fixed pattern "LOGO" 44.

When the "LOGO" 44 is enlarged or reduced by the printing style setting unit 10 as described above, the interval 43 is enlarged or reduced at the same rate as the "LOGO" 44. The interval 43 may be set to an optional length by the printing style setting unit 10. The enlarged "LOGO" 44 and reduced "LOGO" 44 may be alternately printed on the back side 42*b*. Combination of enlarged "LOGO" 44 and reduced "LOGO" 44 can be optionally set by the printing style setting unit 10.

Figure 6:
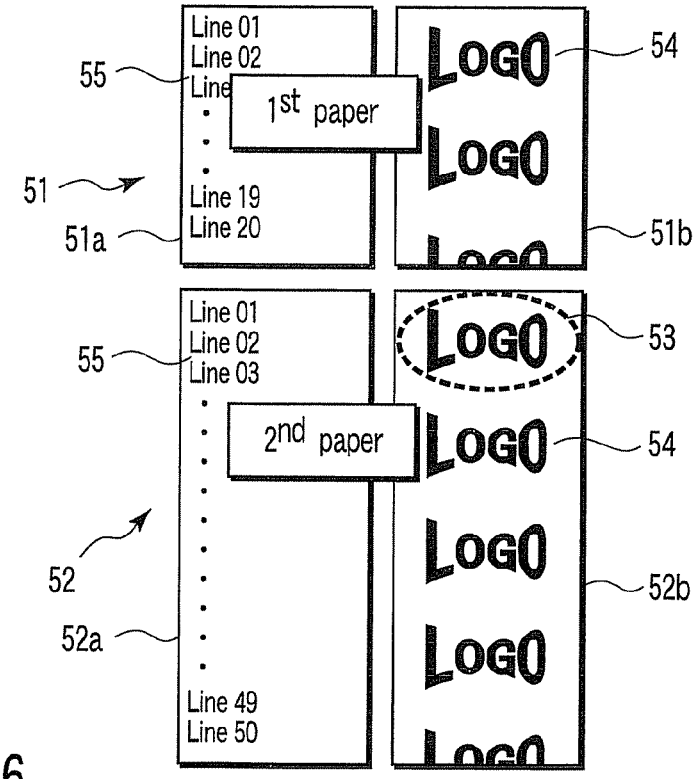
FIG. 6 is a view showing a fourth example of a fixed pattern to be printed on a back side by a second thermal head.

FIG. 6 shows a fourth example of a fixed pattern printed on the back side by the second thermal head 2.

In the fourth example shown in FIG. 6, information 55 (Line 01-Line 20) included in the printing data is printed on the front side 5l*a* of a first printing medium 51. A selected fixed pattern "LOGO" 54 is printed on the back side 51*b* of the first printing medium 51. Likewise, information 55 (Line 01-Line 50) included in the printing data is printed on the front side 52*a* of a second printing medium 52. A selected fixed pattern "LOGO" 54 is printed on the back side 52*b* of the second printing medium 52 with a specified space.

In the fourth example, a print start timing is synchronized with the conveying state of printing medium 51 and 52 (the forward ends of the printing medium 51 and 52 reach the second thermal head 2). In the fourth example, printing of fixed pattern is started each time the duplex printer is given a print start instruction. Therefore, in the fourth example, even if the previously printed fixed pattern "LOGO" 54 at the rear end of the back side of a first printing medium ends halfway, a succeeding fixed pattern "LOGO" 54 at the forward end of the back side of a second printing medium is printed from the beginning. Namely, even if the fixed pattern "LOGO" 54 printed on the back side 51*b* of the first printing medium 51 ends halfway, the fixed pattern "LOGO" 54 is printed from the beginning on the back side 52*b* of the second printing medium 52.

By combining the fourth example with the first to third examples, printing of fixed patterns without a break can be always started from the forward end portion of a back side of a printing medium.

As explained hereinbefore, according to the duplex printer of this embodiment, as printing data is printed on a front side (information printing side), a fixed pattern or notice information set on a back side (information non-printing side) can be printed. This eliminates the necessity of using a high-cost printing medium with preprinted fixed pattern or notice information on a back side.

Moreover, a fixed pattern or notice information to be printed on an information non-printing side can be easily set by the user. Therefore, the user can print a desired fixed pattern or latest notice each time the user wants. This enables the user to use a low-cost printing medium. Further, it is unnecessary to prepare a printing medium with a preprinted back side. This eliminates the necessity to stock a needless printing medium, and to dispose a printing medium becoming needless.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A duplex printer comprising:

a conveying mechanism which pulls out and conveys a printing medium in which the printing medium is wound and a first side and second side thereof are thermal recording sides, the conveying mechanism being configured to store the printing medium, and the printing medium being cut by each piece of printing data that has been printed;

a first thermal head which contacts the first side of the conveying printing medium, and prints information included in printing data;

a second thermal head which contacts the second side of the printing medium, and prints specified information on the second side repeatedly;

a memory which stores the printing data and one or more fixed pattern and notice information;

a printing style setting unit which selects and sets a printing style for the printing data, and the fixed pattern or notice information becoming the specified information; and a drive control unit which controls conveyance of the printing medium and printing of the first thermal head and the second thermal head, wherein when a plurality of pieces printing data are printed on the first side of the printing medium consecutively by the first thermal the drive control unit is configured to start the printing of the fixed pattern or notice information on the second side from the beginning in order by the second thermal head, in sychronization with the timing that a head of the conveyed printing medium contacts the second thermal head, and to perform control so that on the back side, the fixed pattern or notice information is printed from the beginning at all times, and the printing by the second thermal head is completed in light of the area of the printing medium to be printed by the first thermal head for conformity of the printed area.

2. The duplex printer according to claim 1, wherein the second thermal head repeatedly prints the fixed pattern or notice information on the second side of the printing medium, at regular cycle or at an optional timing.

3. The duplex printer according to claim 2, wherein the regular cycle that the second thermal head prints on the second side of the printing medium is to repeatedly print one of the fixed pattern and notice information and a space including a specified gap subsequent to one of the fixed pattern and notice information.

4. The duplex printer according to claim 2, wherein the regular cycle that the second thermal head prints on the second side of the printing medium is to repeatedly print the fixed pattern or notice information and a subsequent fixed pattern or notice information with a specified interval taken therebetween.

5. The duplex printer according to claim 2, wherein the optional timing that the second thermal head prints on the second side of the printing medium is to start printing the fixed pattern or notice information when the forward end of the printing medium reaches the second thermal head.

6. The duplex printer according to claim 3, wherein the printing style setting unit sets an enlarging rate of enlarging the size of the fixed pattern or notice information, or a reducing rate of reducing the size of the fixed pattern or notice information.

7. The duplex printer according to claim 6, wherein the printing style setting unit enlarges the gap at the enlarging rate.

8. The duplex printer according to claim 6, wherein the printing style setting unit reduces the gap at the reducing rate.

9. The duplex printer according to claim 6, wherein the printing style setting unit enlarges or reduces the gap at an optional rate.

10. The duplex printer according to claim 6, wherein the printing style setting unit combines printing positions of the fixed pattern or notice information set at the enlarging or reducing rate.

11. The duplex printer according to claim 4, wherein the printing style setting unit sets an enlarging rate of enlarging the size of the fixed pattern or notice information, or a reducing rate of reducing the size of the fixed pattern or notice information.

12. The duplex printer according to claim 11, wherein the printing style setting unit enlarges the interval at the enlarging rate.

13. The duplex printer according to claim 11, wherein the printing style setting unit reduces the interval at the reducing rate.

14. The duplex printer according to claim 11, wherein the printing style setting unit enlarges or reduces the interval at an optional rate.

15. The duplex printer according to claim 11, wherein the printing style setting unit combines printing positions of the fixed pattern or notice information set at the enlarging or reducing rate.

* * * * *